US011316244B2

(12) United States Patent
Ruiz

(10) Patent No.: US 11,316,244 B2
(45) Date of Patent: Apr. 26, 2022

(54) ADJUSTABLE ANTENNA MOUNT

(71) Applicant: CommScope Technologies LLC, Hickory, NC (US)

(72) Inventor: Guilibaldo Ruiz, McKinney, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/136,502

(22) Filed: Dec. 29, 2020

(65) Prior Publication Data

US 2021/0257709 A1 Aug. 19, 2021

Related U.S. Application Data

(60) Provisional application No. 62/977,575, filed on Feb. 17, 2020.

(51) Int. Cl.
*H01Q 1/12* (2006.01)
*H01Q 1/24* (2006.01)

(52) U.S. Cl.
CPC ..... *H01Q 1/1228* (2013.01); *H01Q 1/1242* (2013.01); *H01Q 1/246* (2013.01)

(58) Field of Classification Search
CPC .... H01Q 1/125; H01Q 1/1207; H01Q 1/1242; H01Q 1/1228; H01Q 1/246
See application file for complete search history.

(56) References Cited

U.S. PATENT DOCUMENTS 6,111,553 A 8/2000 Steenbuck
9,433,034 B2 8/2016 Hendrix et al.
2018/0254545 A1 9/2018 Hendrix et al.
2020/0106169 A1* 4/2020 Ahmed ..... H01Q 1/36
2020/0136236 A1 4/2020 Colapietro et al.
2020/0388902 A1 12/2020 Colapietro et al.

FOREIGN PATENT DOCUMENTS

CN 106207370 A 12/2016
CN 206134913 U 4/2017
CN 110571509 A 12/2019
KR 20160033568 A 3/2016

OTHER PUBLICATIONS

"International Search Report and Written Opinion corresponding to International Application No. PCT/US2020/067249 dated Apr. 27, 2021".

* cited by examiner

*Primary Examiner* — Robert Karacsony
(74) *Attorney, Agent, or Firm* — Myers Bigel, P.A.

(57) ABSTRACT

An adjustable mount for an antenna includes: a generally vertical pole; a plurality of rails mounted adjacent the pole's upper end, each of the rails including a cap with a mounting hole at its upper end; a mounting foundation having a base panel and a mounting platform positioned above the base panel, the base panel including a set of discontinuous slots extending at an oblique angle to a radius originating at a center point of the base panel; a plurality of threaded members inserted into the mounting hole of a respective one of the rails and one of the set of discontinuous slots to mount the mounting foundation above the upper end of the pole; and a plurality of nuts threaded onto a respective threaded member beneath the base panel. Rotation of the nut relative to the threaded member causes an overlying section of the base panel to move vertically.

20 Claims, 5 Drawing Sheets

ADJUSTABLE ANTENNA MOUNT

RELATED APPLICATION

The present application claims priority from and the benefit of U.S. Provisional Patent Application No. 62/977,575, filed Feb. 17, 2020, the disclosure of which is hereby incorporated herein be referenced in its entirety.

FIELD OF THE INVENTION

The present invention is directed generally toward communication antennas, and more particularly to mounting structures for communications antennas.

BACKGROUND

As wireless data service demands have grown, a conventional response has been to increase the number and capacity of conventional cellular Base Stations (Macro-Cells). Such Macro-Cells are typically mounted on antenna towers. A conventional antenna tower has three or four legs on which antennas and supporting remote radio units (RRUs) are mounted. However, in some environments structures known as "monopoles" are used as mounting structures. Monopoles are typically employed when fewer antennas/RRUs are to be mounted, and/or when a structure of less height is required.

In addition, Macro-Cell sites are becoming less available, and available spectrum limits how much additional capacity can be derived from a given Macro-Cell. Accordingly, small cell RRU and antenna combinations have been developed to "fill in" underserved or congested areas that would otherwise be within a Macro-Cell site. Deployment of small cells, particularly in urban environments, is expected to continue to grow. Often such small cell configurations (sometimes termed "metrocells") are mounted on monopoles.

Some small cell antenna configurations may comprise a generally cylindrical unit with three antennas deployed at 120 degree angles to one another. An exemplary cylindrical antenna unit is shown in U.S. Pat. No. 9,433,034 to Hendrix, the disclosure of which is hereby incorporated herein in its entirety. Such antenna units are typically mounted on the top of a monopole.

In some instances, operators are employing wooden poles (such as telephone poles or power poles) that are already present in a particular location to mount metrocells. Wooden poles tend to be somewhat variable in size and condition. As such, it may be desirable to provide mounting systems that can facilitate the mounting of metrocells on wooden poles.

SUMMARY

As a first aspect, embodiments of the invention are directed to an adjustable mount for an antenna. The adjustable mount comprises: a generally vertical elongate pole having an upper end; a plurality of rails mounted adjacent the upper end of the pole, each of the rails including a cap with a mounting hole at an upper end thereof; a mounting foundation having a base panel and a mounting platform positioned above the base panel, the base panel including a set of discontinuous slots, each of the discontinuous slots extending at an oblique angle to a radius originating at a center point of the base panel; a plurality of threaded members, each of the threaded members inserted into the mounting hole of a respective one of the rails and one of the set of discontinuous slots to mount the mounting foundation above the upper end of the pole; and a plurality of nuts, each threaded onto a respective threaded member beneath the base panel, wherein rotation of the nut relative to the threaded member causes an overlying section of the base panel to move vertically.

As a second aspect, embodiments of the invention are directed to an adjustable mount for an antenna comprising: a generally vertical elongate pole having an upper end; a plurality of rails mounted adjacent the upper end of the pole, each of the rails including a cap with a mounting hole at an upper end thereof; a mounting foundation having a generally triangular base panel and a generally square mounting platform positioned above the base panel, the base panel including a set of discontinuous slots, each of the discontinuous slots extending at an oblique angle to a radius originating at a center point of the base panel; a plurality of threaded members, each of the threaded members inserted into the mounting hole of a respective one of the rails and one of the set of discontinuous slots to mount the mounting foundation above the upper end of the pole; and a plurality of nuts, each threaded onto a respective threaded member beneath the base panel, wherein rotation of the nut relative to the threaded member causes an overlying section of the base panel to move vertically.

As a third aspect, embodiments of the invention are directed to a method of leveling an antenna mount on a pole, comprising the steps of: providing a generally vertical elongate pole having an upper end; mounting a plurality of rails adjacent the upper end of the pole, each of the rails including a cap with a mounting hole at an upper end thereof; providing a mounting foundation having a base panel and a mounting platform positioned above the base panel, the base panel including a set of discontinuous slots, each of the discontinuous slots extending at an oblique angle to a radius originating at a center point of the base panel; mounting the mounting foundation on the rails above the upper end of the pole with a plurality of threaded members and a plurality of nuts, each of the threaded members inserted into the mounting hole of a respective one of the rails and one of the set of discontinuous; and rotating at least one of the plurality of nuts relative to the threaded rod to cause an overlying section of the base panel to move vertically.

DETAILED DESCRIPTION

Figure 1:
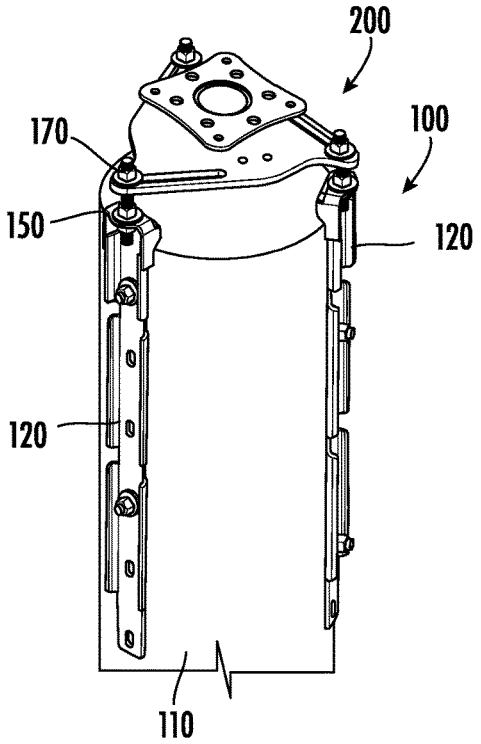
FIG. 1 is a top perspective view of an antenna mount leveling assembly according to embodiments of the invention.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, an antenna mount leveling assembly is illustrated in FIGS. 1-5 and designated broadly at 100. The assembly 100 is mounted on a wooden pole 110 and includes a mounting foundation 200, three rails 120, three threaded rods 150 (or other threaded members), and twelve nuts 170. These are described in greater detail below.

Figure 2:
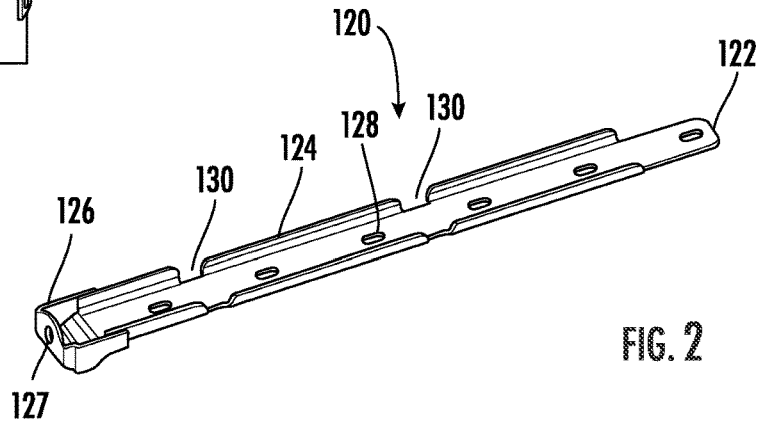
FIG. 2 is a perspective view of a rail of the assembly of FIG. 1.

Referring first to FIG. 2, each of the three rails 120 includes an elongate main panel 122 with side flanges 124. An overhanging cap 126 with a hole 127 covers one end of the rail 120. Mounting slots 128 are present in the main panel 122. In some embodiments, the slots 128 are about 4 inches apart. Recesses 130 are present in the side flanges 124.

Figure 3:
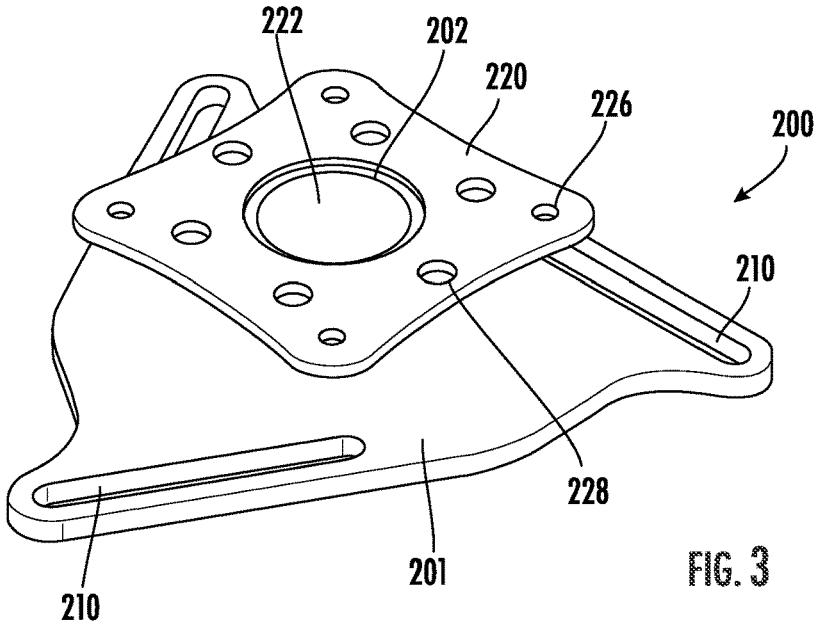
FIG. 3 is a top perspective view of a mounting foundation of the assembly of FIG. 1.

Referring now to FIG. 3, the mounting foundation 200 has a base plate 201 that is generally planar and somewhat triangular in shape. A hole 202 is present in the center of the base plate 201 to provide routing for cables. An oblong slot 210 is present in each of the "corners" of the base plate 201 and extends toward an adjacent corner. The slots 210 are oriented such that they extend at an oblique angle to a radius originating in the center of the base plate 201. A generally square mounting platform 220 is attached to a cylindrical tower 222, which is in turn mounted to the base plate 201 to surround the hole 202. The mounting platform 220 includes four mounting holes 226 in the corners and six mounting holes 228 that ring the tower 222.

As can be seen in FIG. 1, the assembly 100 can be mounted to the wooden pole 110 by first attaching the rails 120 about the periphery of the pole 110 in a vertical orientation via screws inserted into the slots 128. In some embodiments, the screws are inserted such that two slots 128 are present between screws. Each of the rails 120 is oriented so that the side flanges 124 extend radially outwardly from the pole 110. The cap 126 rests on the top surface of the pole 110.

It should be noted that, in some embodiments, the rails 120 may be mounted to the pole 110 via bands (e.g., a hose clamp) that encircle the pole 110 and fit within the recesses 130 of the rails 120. (If three bands are to be used, two bands can fit within the recesses 130 in the rails 120 and one band can overlie the lower "tail" of the rail 120 below the side flanges 124.) In such embodiments, each band may engage and secure all three of the rails 120.

Figure 4:
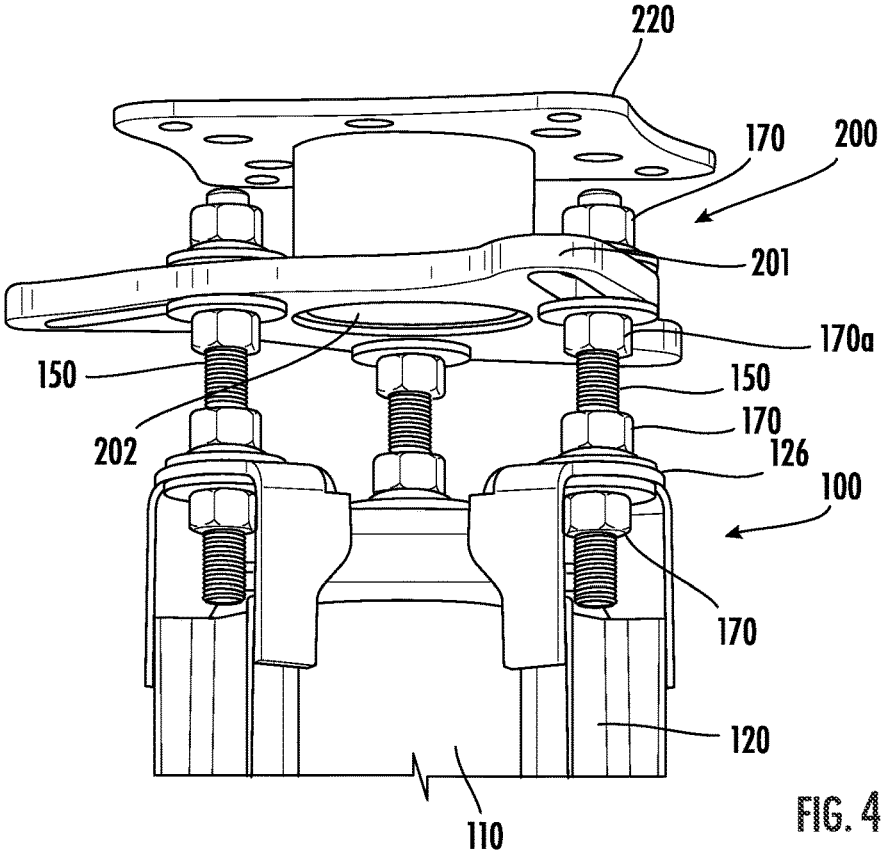
FIG. 4 is a bottom perspective view of the assembly of FIG. 1.
Figure 5:
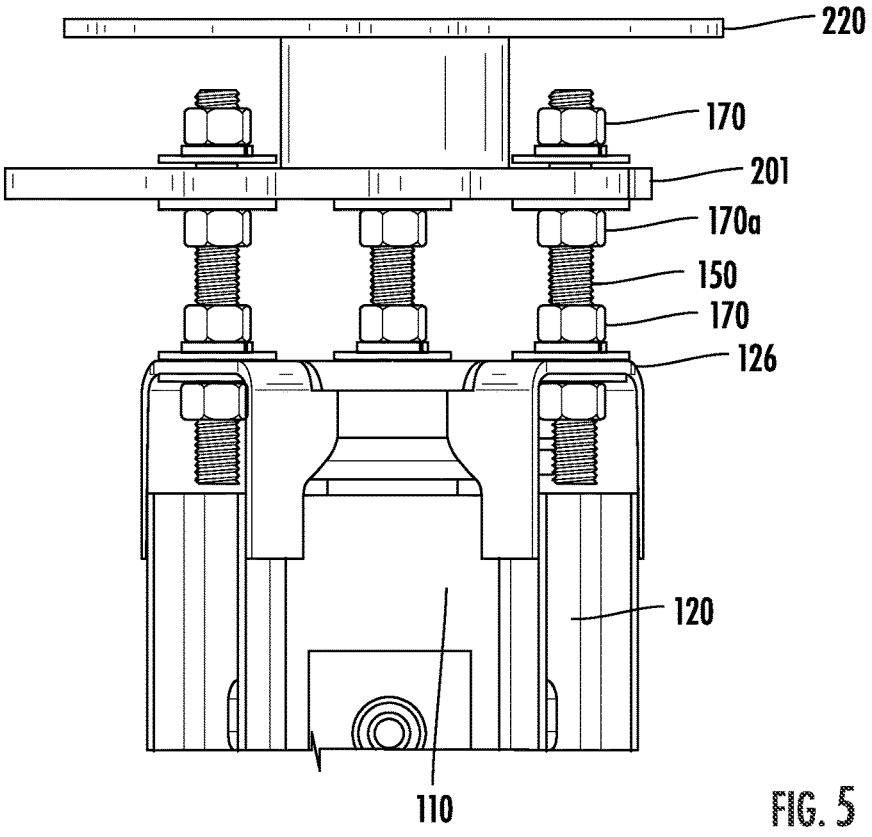
FIG. 5 is a side view of the assembly of FIG. 1.

The mounting foundation 200 is then mounted to the rails 120. As can be seen in FIGS. 1, 4 and 5, the threaded rods 150 are inserted into the slots 210 in the base panel 201 of the mounting foundation 200, with nuts 170 threaded onto each threaded rod 150 both above and below the base panel 201. The threaded rods 150 are also inserted into the holes 127 in the caps 126 of the rails 120, with nuts 170 threaded onto the rods 150 above and below the caps 126. The length and orientation of the slots 210 enables the mounting foundation to be mounted on poles having a wide variety of diameters.

It can be seen that the arrangement illustrated and described herein can be employed to both mount and level the mounting foundation 200 onto the pole 110. As discussed above, poles, and particularly wooden poles, can vary greatly in size, roundness, and perpendicularity of mounting, and the top surfaces of different poles can vary greatly in their degree of flatness. The assembly 100 can enable a technician to adjust the mounting foundation 200 to a desired orientation (typically level), by rotating the nuts 170 (in particular the nuts 170*a*, which underlie the base plate 201, may be rotated) on their respective threaded rods 150; such rotation of the nuts 170 raises or lowers the corners of the mounting foundation 200 relative to each other, which adjusts the angle of the base plate 201 and mounting platform 220 relative to the pole 110 (and, in turn, to the horizon). In some embodiments, the technician may employ a level or other angle-detecting device as an aid to confirm that the desired orientation has been attained.

In addition, the inclusion of the rails 120 on the pole 110 and the slots 210 in the base panel 201 of the mounting foundation 200 can also permit the mounting foundation 200 to be mounted on poles of varying diameters, and even varying degrees of roundness.

Figure 6:
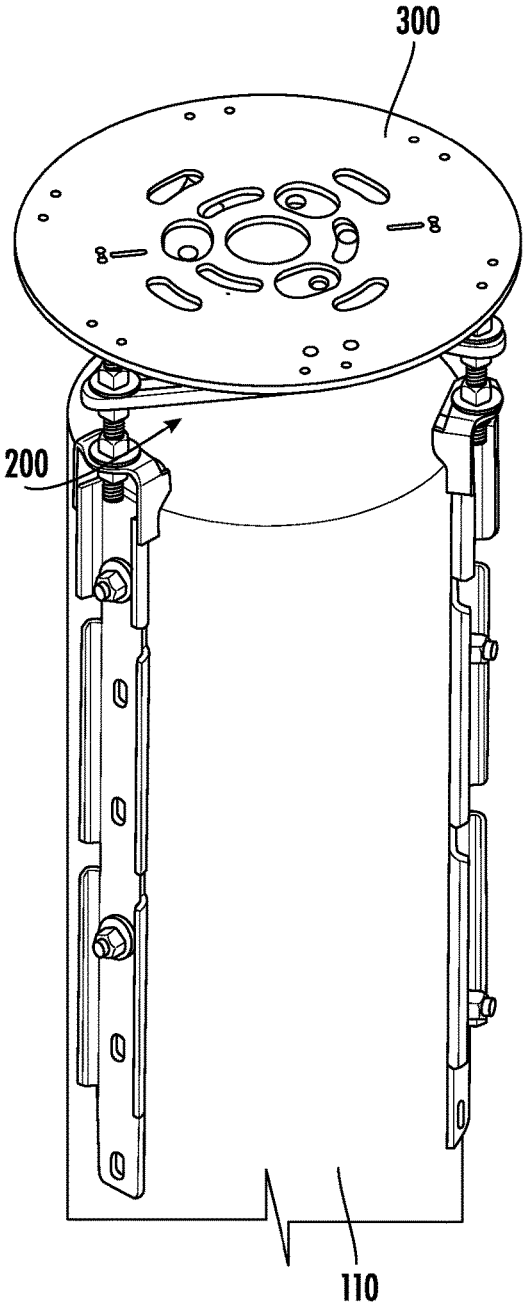
FIG. 6 is a top perspective view of the assembly of FIG. 1 with a bottom plate of an equipment module mounted thereon.
Figure 7:
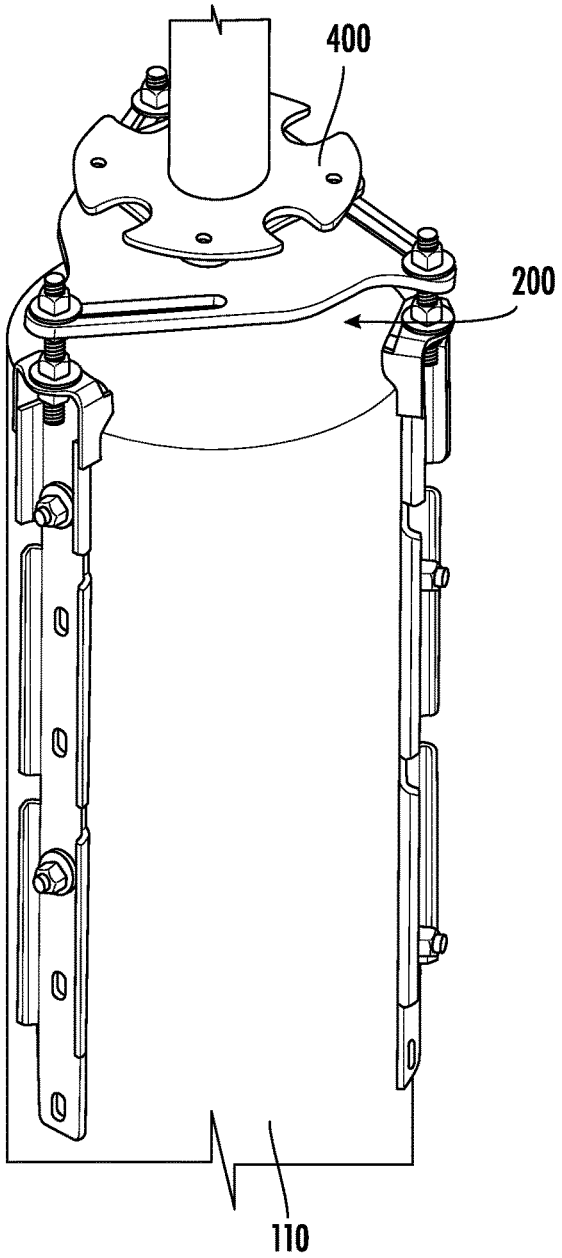
FIG. 7 is a top perspective view of the assembly of FIG. 1 with a bottom plate of an antenna module mounted thereon.

Once the mounting foundation 200 is mounted on the pole 110 as described above, equipment (such as an antenna, a radio, or the like) can be mounted on the mounting foundation 200. FIG. 6 illustrates the mounting of the bottom plate 300 of an equipment module, and FIG. 7 illustrates the mounting of the lower end of a spool 400 employed with an antenna module (such as a so-called "5G" antenna). The bottom plate 300 and spool 400 include mounting holes that align with either or both of the holes 226, 228 in the mounting platform 220. It will be understood that the adjustment of the orientation of the mounting foundation 200 may be performed prior to or after the mounting of the equipment on the pole 110.

Figure 8:
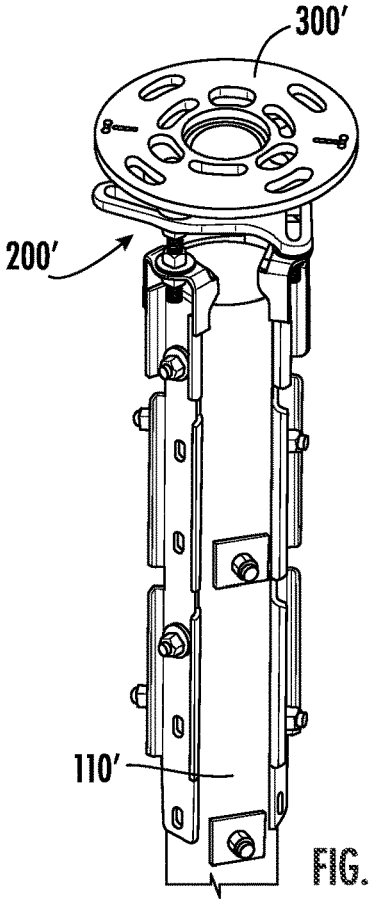
FIG. 8 is a top perspective view of an assembly of FIG. 1 using a smaller mounting foundation, with a bottom plate of an equipment module mounted thereon.
Figure 9:
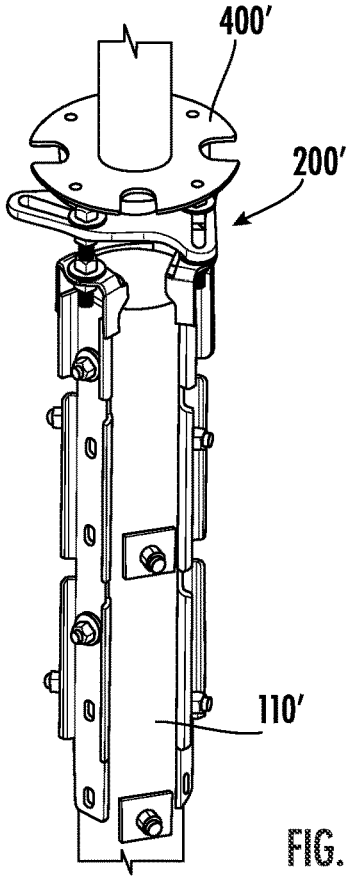
FIG. 9 is a top perspective view of the assembly of FIG. 8 with a smaller bottom plate of an antenna module mounted thereon.
Figure 10:
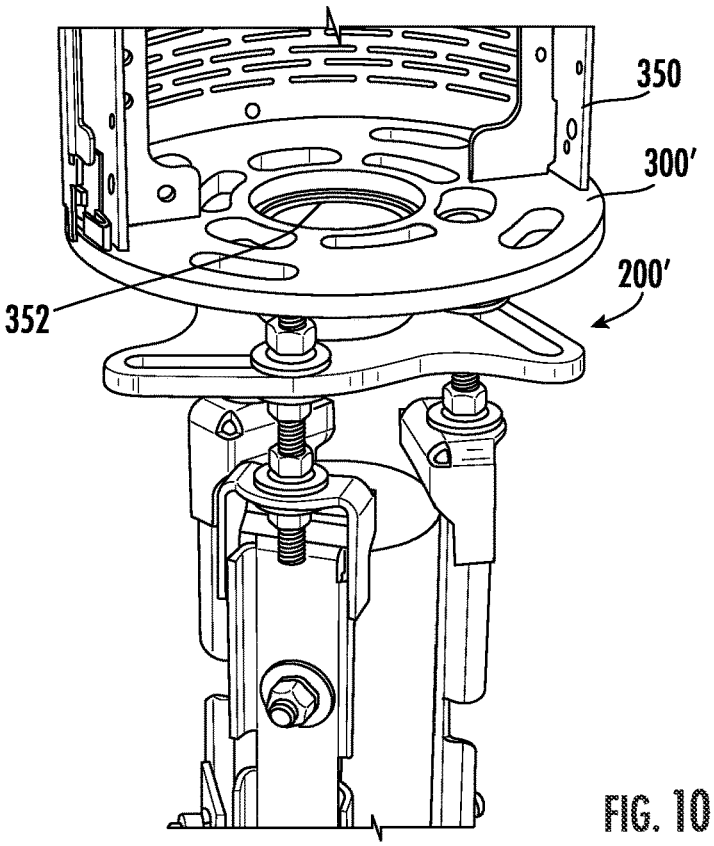
FIG. 10 is a partial top perspective view of the assembly of FIG. 8 showing a portion of the equipment module.

FIGS. 8 and 9 illustrate the use of a somewhat smaller mounting foundation 200', which is similar to the mounting foundation 200 but is smaller in size, and thus may be more appropriate for mounting on a smaller diameter pole 110'. FIG. 8 illustrates the mounting of a bottom plate 300' on the mounting foundation 200', and FIG. 9 illustrates the mounting of the bottom portion of a spool 400'. FIG. 10 shows the lower portion of an equipment module 350 attached to the bottom plate 300'. It can be seen that the bottom plate 300' includes a central hole 352 through which cables can be routed.

Figure 11:
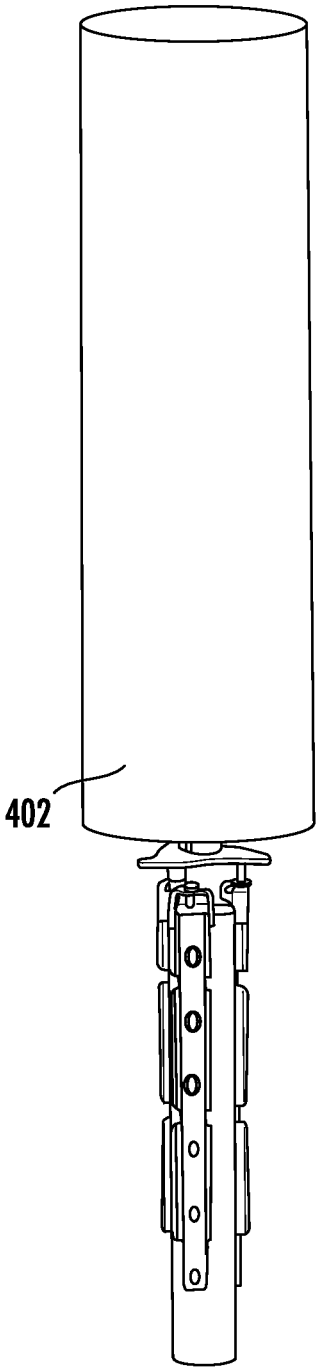
FIGS. 11 and 12 are side perspective views of the assembly of FIG. 8 mounted on different sized wooden poles and with antenna modules mounted thereon.
Figure 12:
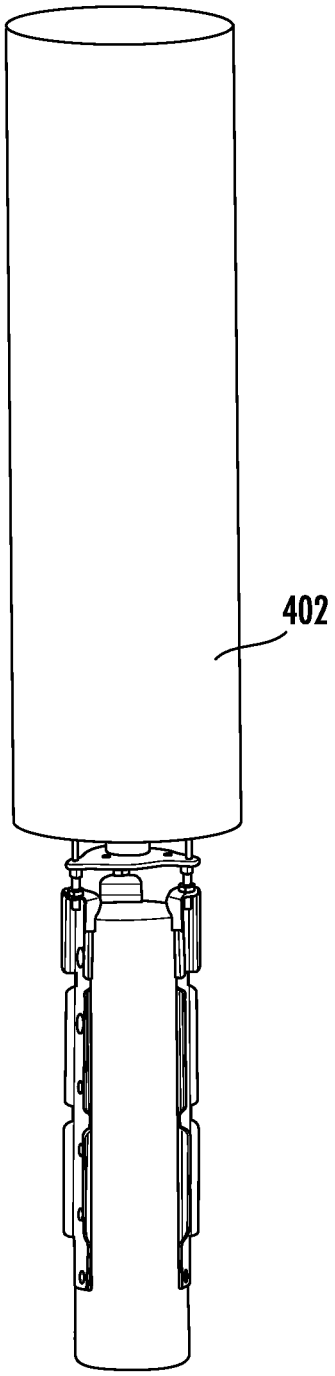

FIGS. 11 and 12 illustrate the mounting of an antenna module 402 on poles of different diameters.

The mounting foundation 200 is typically formed of a metallic material, such as steel or aluminum. The base panel 201 may be of any thickness, but should be of sufficient thickness to provide a rigid mounting location for the antenna or other equipment; a thickness of between about 0.188 and 0.5 inch is typical. Similarly, the mounting platform 220 may be should be of sufficient thickness to provide a rigid mounting location for the antenna; a thickness of between about 0.188 and 0.5 inch is typical.

It should also be noted that the base plate 201, which is shown to be generally triangular, may take another shape (e.g., circular, square, hexagonal), as may the mounting platform 220. The holes 226, 228 in the mounting platform 220 may be arranged in a different pattern. The hole patterns in the bottom plate 300, 300' (which are discussed in U.S. Patent Publication No. 2020/0388902, the disclosure of which is hereby incorporated by reference herein in full) may also vary. In some embodiments, the threaded rods 150 may be integrated into the rails 120. Other variations may also be employed.

It should also be understood that the assembly 100 may be employed to mount other equipment, such as radios (particularly within a module), 4G or 5G antennas, and other types of modules (e.g., power modules); exemplary modules are discussed in U.S. Pat. Publication Nos. 2018/0254545, and 2020/0136236. Both of these documents are hereby incorporated herein by reference in full.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An adjustable mount for an antenna, comprising:

a generally vertical elongate pole having an upper end;

a plurality of rails mounted adjacent the upper end of the pole, each of the rails including a cap with a mounting hole at an upper end thereof;

a mounting foundation having a base panel and a mounting platform positioned above the base panel, the base panel including a set of discontinuous slots, each of the discontinuous slots extending at an oblique angle to a radius originating at a center point of the base panel;

a plurality of threaded members, each of the threaded members inserted into the mounting hole of a respective one of the rails and one of the set of discontinuous slots to mount the mounting foundation above the upper end of the pole; and a plurality of nuts, each threaded onto a respective threaded member beneath the base panel, wherein rotation of the nut relative to the threaded member causes an overlying section of the base panel to move vertically.

2. The adjustable mount defined in claim 1, wherein the plurality of rails comprises three rails, and wherein the set of slots comprises three slots.

3. The adjustable mount defined in claim 2, wherein the plurality of threaded members comprises three threaded members.

4. The adjustable mount defined in claim 1, wherein the slots are oblong slots.

5. The adjustable mount defined in claim 1, wherein the base panel is generally triangular in shape.

6. The adjustable mount defined in claim 1, wherein the mounting platform is generally square in shape.

7. The adjustable mount defined in claim 1, wherein plurality of nuts comprises twelve nuts.

8. The adjustable mount defined in claim 1, in combination with a telecommunications equipment module mounted to the mounting platform.

9. The adjustable mount defined in claim 1, wherein the elongate pole is formed of wood.

10. An adjustable mount for an antenna, comprising:

a generally vertical elongate pole having an upper end;

a plurality of rails mounted adjacent the upper end of the pole, each of the rails including a cap with a mounting hole at an upper end thereof;

a mounting foundation having a generally triangular base panel and a generally square mounting platform positioned above the base panel, the base panel including a set of discontinuous slots, each of the discontinuous slots extending at an oblique angle to a radius originating at a center point of the base panel;

a plurality of threaded members, each of the threaded members inserted into the mounting hole of a respective one of the rails and one of the set of discontinuous slots to mount the mounting foundation above the upper end of the pole; and a plurality of nuts, each threaded onto a respective threaded member beneath the base panel, wherein rotation of the nut relative to the threaded member causes an overlying section of the base panel to move vertically.

11. The adjustable mount defined in claim 10, wherein the elongate pole is formed of wood.

12. A method of leveling an antenna mount on a pole, comprising the steps of:

providing a generally vertical elongate pole having an upper end;

mounting a plurality of rails adjacent the upper end of the pole, each of the rails including a cap with a mounting hole at an upper end thereof;

providing a mounting foundation having a base panel and a mounting platform positioned above the base panel, the base panel including a set of discontinuous slots, each of the discontinuous slots extending at an oblique angle to a radius originating at a center point of the base panel;

mounting the mounting foundation on the rails above the upper end of the pole with a plurality of threaded members and a plurality of nuts, each of the threaded members inserted into the mounting hole of a respective one of the rails and one of the set of discontinuous slots; and rotating at least one of the plurality of nuts relative to the threaded member to cause an overlying section of the base panel to move vertically.

13. The method defined in claim 12, wherein the plurality of rails comprises three rails, and wherein the set of slots comprises three slots.

14. The method defined in claim 13, wherein the plurality of threaded members comprises three threaded members.

15. The method defined in claim 12, wherein the slots are oblong slots.

16. The method defined in claim 12, wherein the base panel is generally triangular in shape.

17. The method defined in claim 12, wherein the mounting platform is generally square in shape.

18. The method defined in claim 12, wherein plurality of nuts comprises twelve nuts.

19. The method defined in claim 12, further comprising the step of mounting a telecommunications equipment module to the mounting platform.

20. The method defined in claim 12, wherein the elongate pole is formed of wood.

* * * * *